United States Patent [19]

Kramer

[11] Patent Number: 4,767,317

[45] Date of Patent: Aug. 30, 1988

[54] APPARATUS FOR MIXING A GAS MAIN FLOW WITH AT LEAST ONE GAS SUBFLOW

[76] Inventor: Carl Kramer, Am Chorusberg 8, D-5100 Aachen, Fed. Rep. of Germany

[21] Appl. No.: 822,165

[22] Filed: Jan. 24, 1986

[30] Foreign Application Priority Data

Jan. 26, 1985 [DE] Fed. Rep. of Germany ..... 3502648

[51] Int. Cl.[4] ..... F23C 5/32

[52] U.S. Cl. ..... 431/173; 432/222; 415/116; 34/47

[58] Field of Search ..... 431/173, 183; 432/222, 432/152, 176, 200, 201, 203; 34/47; 98/38.1, 38.9; 415/116, 117

[56] References Cited

U.S. PATENT DOCUMENTS

| | | | |
|---|---|---|---|
| 2,508,792 | 5/1950 | Ludwig | 432/222 |
| 3,117,770 | 1/1964 | Campbell | 432/222 |
| 3,367,570 | 2/1968 | Reichmann | 432/222 X |
| 3,849,906 | 11/1974 | Hansen et al. | 34/229 |
| 3,922,108 | 11/1975 | Benisek | 415/116 |
| 4,030,712 | 6/1977 | Rogers | 266/252 |
| 4,078,576 | 3/1978 | Punch et al. | 98/38.1 X |
| 4,374,637 | 2/1983 | Zwick et al. | 431/183 |
| 4,395,233 | 7/1983 | Smith et al. | 432/176 |

FOREIGN PATENT DOCUMENTS

| | | | |
|---|---|---|---|
| 27330 | 6/1932 | Netherlands | 432/222 |
| 1568706 | 6/1980 | United Kingdom | 432/203 |

OTHER PUBLICATIONS

"Jetflow Airmover", by Norfi Unwelttechnik.

*Primary Examiner*—Margaret A. Focarino
*Attorney, Agent, or Firm*—Armstrong, Nikaido, Marmelstein & Kubovcik

[57] ABSTRACT

An apparatus for mixing a gas main flow with at least one gas subflow comprises a round inlet region which tapers in the flow direction and over the periphery of which influx openings are distributed for the gas subflow. From these influx openings the gas subflow emerges with a tangential direction component, giving a good mixing with the gas main flow.

13 Claims, 5 Drawing Sheets

APPARATUS FOR MIXING A GAS MAIN FLOW WITH AT LEAST ONE GAS SUBFLOW

BACKGROUND OF THE INVENTION

1. Field of the Invention

The present invention relates to an apparatus for mixing a gas main flow with at least one gas subflow. The gas main flow enters a more particularly round inlet region which tapers in the flow direction. The gas subflow emerges through influx openings which are distributed over the periphery of the inlet region.

2. Description of the Prior Art

In many technical fields of use, for example in driers and industrial furnaces, a gas main flow must be mixed with at least one gas subflow or secondary flow. In particular in industrial furnaces or driers, different gas flows frequently have very different temperatures. Thus, if from the various gas flows a single homogeneous gas flow, with very exactly defined temperature is to be formed, complicated provisions must be made.

Another aim with such apparatuses is to keep the flow losses small. For this reason, particular care must be devoted to the flow path and in particular fans used which have a good efficiency, i.e. do not appreciably mix the gas flows, which however counteracts the desired uniform thorough mixing. Thus, here particular provisions are necessary to avoid temperature streaks or strings.

SUMMARY OF THE INVENTION

The invention is thus based on the problem of providing an apparatus for mixing a gas main flow with at least one gas subflow of the type indicated in which the aforementioned disadvantages do not occur.

In particular, an apparatus is to be proposed which, with a constructionally simple flow guiding and path, ensures a very uniform mixing of the various gas flows without additional appreciable pressure loss occurring.

Therefore, the invention proposes an apparatus for mixing a gas main flow with at least one gas subflow. The gas main flow enters a more particularly round inlet region which tapers in the flow direction. The gas subflow emerges through influx openings which are distributed over the periphery of the inlet region.

Expedient embodiments are set forth in the subsidiary claims.

The advantages achieved with the invention are based in particular on the fact that the gas subflow or subflows are supplied in a flow region of the gas main flow in which the flow undergoes a pronounced convective acceleration. Such a flow region is for example the entry region of a fan into which the gas main flow moves from a larger space, for example the interior of a chamber furnace or of a drier. The advantageous effect of the invention can be still further enhanced in that by the flow guiding, to be explained hereinafter, the gas subflow or the gas subflows is or are given a tangential component with respect to the flow direction of the gas main flow, i.e. subjected to a twisting effect which permits a good mixing with the gas main flow. This twist can for example be directed, in the case of a radial fan, so that with respect to the direction of rotation of the fan a counter twist results, thereby still further intensifying the pressure increase in the part of the gas subflow provided with the counter twist. Depending on the embodiment of the radial fan, when this gas subflow emerges provided with a twist having relatively high speed, the filling of the fan wheel can further improve, additionally giving a favourable efficiency of the fan. With hot gas fans for example, it is possible in this manner to provide the curving of the fan cover disc with a smaller radius as would otherwise be desirable for fluid mechanics reasons. This has considerable constructional advantages and a greater strength important for higher temperatures.

In order to be able to mix the hot exhaust gas flow generated by a burner in a string-free or a streak-free manner with the main gas flow sucked in by the fan, an annular chamber can be provided surrounding the suction opening of the fan in the manner of a spiral housing for a radial fan. The flow direction in this housing is however converse to that in a radial fan. Due to the form of the spiral housing 4 an influx direction of the gas flow to be admixed which is the same around the periphery results and this ensures likewise a uniform mixing. By the form of the spiral, it is moreover possible to fix the magnitude of the tangential speed component on exit from the influx openings defining the twist of the gas subflow.

Particularly suitable for this installation situation are high-speed burners in which the injector effect of the exhaust gas flow of the burner can additionally be utilized to suck in gas from the surroundings for cooling the flame region through a gap surrounding the burner tube.

The cooling effect achieved in this manner makes it possible, in spite of the high flame temperatures, to use relatively cheap materials with lower heat resistance for making the entry area.

A favourable embodiment is a spiral annular chamber of a heat-resistant steel sheet whose rear side facing the inlet has a certain spacing from the inlet entrance plane. The fraction of the main flow flowing through the gap, formed in this manner, to the inlet then also advantageously contributes to the heat dissipation.

The annular chamber may also be provided on its outer surfaces with ribs which are advantageous from three points of view: they direct the flow, increase the exchange area for the heat transfer and stiffen the structure. By suitable alignment of the ribs, it is also possible to impart a twist to the part of the main flow adjacent the wall.

The hot contact area between the afflux and burner flow is suitable in directly heated drying apparatuses and with corresponding composition of the drier atmosphere for burning solvent gases which collect in the drying.

If such an apparatus is used in a furnace operating with small air excess, a chamber which, considered in the direction of the main flow, is disposed behind the annular chamber for the burner may be used to admix the combustion air necessary for burning gaseous constituents. A possible field of use for this embodiment is the burning of rolling oil in chamber furnaces for roll band coils.

BRIEF DESCRIPTION OF THE DRAWINGS

The invention will be explained hereinafter with reference to examples of embodiment with the aid of the attached schematic drawings, wherein.

DESCRIPTION OF THE PREFERRED EMBODIMENTS

Figure 1:
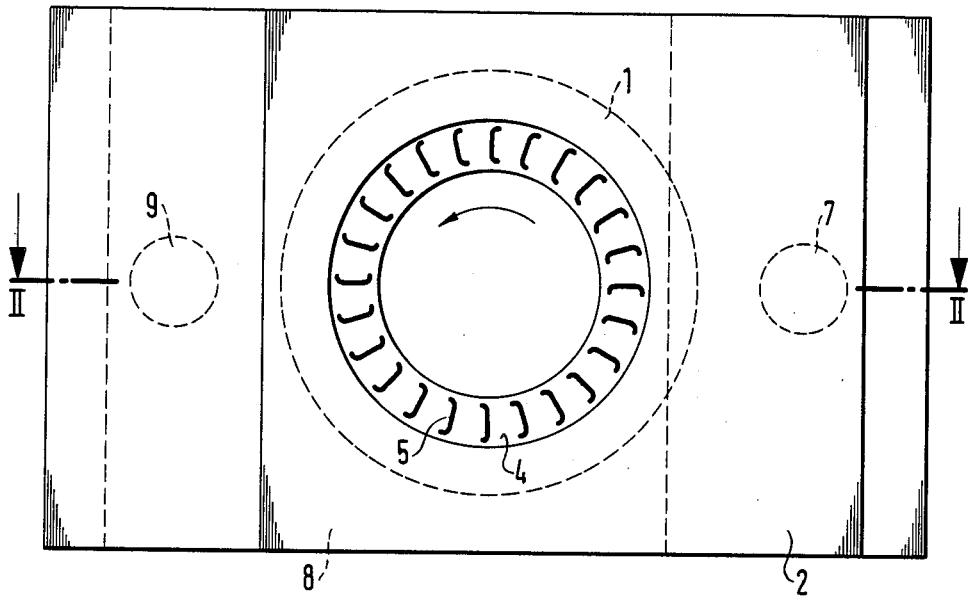
FIG. 1 is an end elevation of an embodiment of an apparatus for mixing a gas main flow sucked in by a radial fan with two gas subflows.

FIG. 1 shows an embodiment in which two gas subflows are mixed with the intake flow of a radial fan 1. The radial fan 1 is in a housing 2 from which the conveyed volume flow can emerge for example upwardly and downwardly or on both sides.

Figure 2:
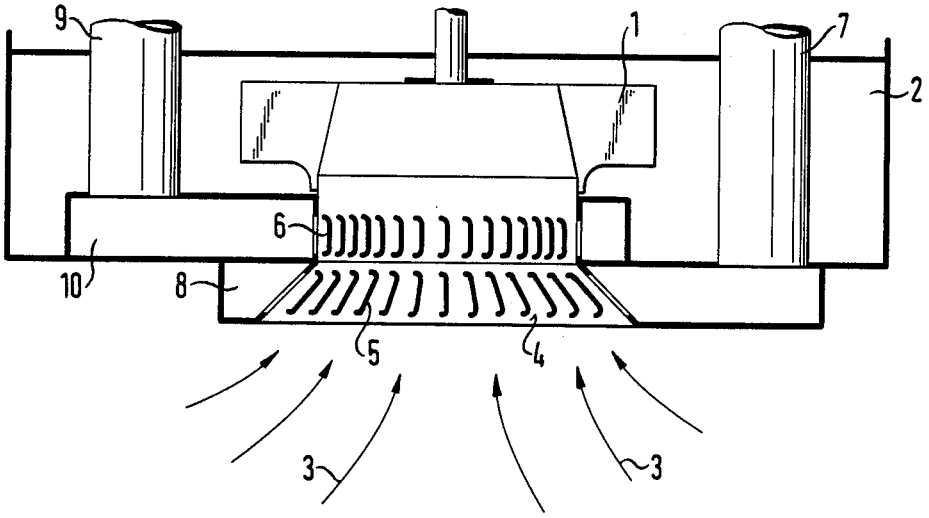
FIG. 2 is a section along the line A—A of FIG. 1.

The gas main flow sucked in as indicated by the flow arrows 3 in FIG. 2 by the radial fan 1 enters through the circular inlet region 4, tapering in the flow direction, into the radial fan wheel 1 and is accelerated by the latter so that in the tapering inlet region 4 a lower pressure is obtained than in the afflux space.

The same mode of operation and effect are achieved if the gas main flow 3 is not sucked in by the radial fan 1 illustrated by FIGS. 1 and 2 but by an axial fan or another flow drive.

At the wall faces of the conically tapering inlet region 4 of the radial fan 1, influx openings are disposed for the gas subflows to be admixed. In the embodiment according to FIG. 2, the influx openings 5 in a first chamber 8 of the inlet region 4 are fed by the gas subflow 7 and the influx openings 6 disposed downstream thereof in a chamber 10 are fed by the gas subflow 9.

Only the wall faces of the first chamber 8 taper in the flow direction, i.e. have a substantially conical form, the chamber 10 having a constant radius, i.e. having a substantially cylindrical form.

By their corresponding flow mechanics form, the openings 5, 6 having in the embodiment according to FIGS. 1 and 2 substantially a gill for. The influx openings 5 and 6 impart to the emerging gas subflows a flow component in the tangential direction with respect to the axis of the inlet region 4 for the main gas flow 3 so that the gas subflows are subjected to a twist. This twist can, for example, be directed in a radial fan so that with respect to the direction of rotation of the fan wheel, a counter twist results. The pressure increase in the component of the gas subflows provided with the counter twist thereby being still further intensified.

Depending on the embodiment of the radial fan at relatively high speed, this emerging twist flow can further improve the filling of the fan wheel so that, in addition, a more favourable efficiency of the radial fan 1 is obtained.

In hot gas fans this makes it possible, for example, to give the curve of the fan cover disc a smaller radius than would otherwise be desirable from the fluid mechanics point of view. This leads to a higher strength of the cover disc.

As can be seen from FIG. 2, the gas subflows 7 and 9 are transported opposite to the conveying direction of the radial fan 1 in the axial direction and then deflected through an angle of 90° into the radial direction so that they can emerge via the influx openings 5, 6.

Instead of making the influx openings 5, 6 in gill form, in the manner illustrated, other configurations may also be used which impart to the emerging gas subflow the tangential component described. If no tangential component is necessary, the influx openings can also be made as simple holes or slits.

Figure 3:
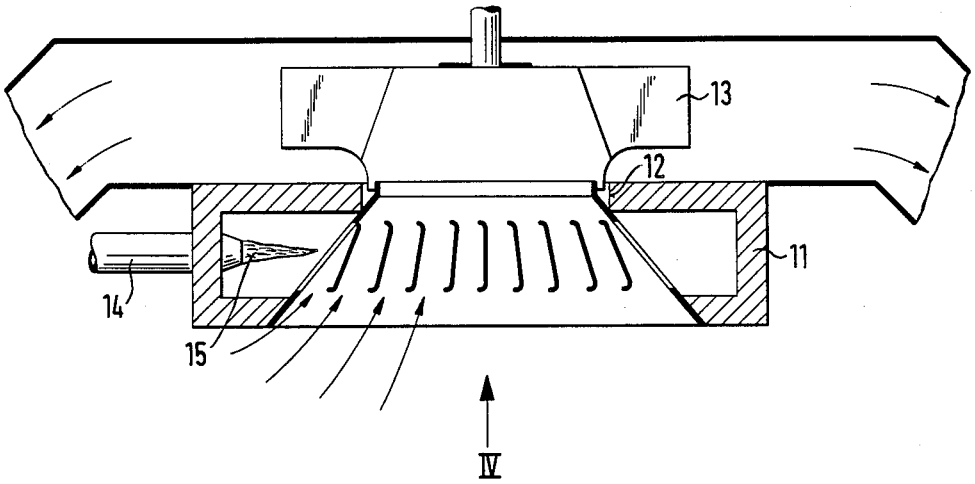
FIG. 3 is a section through a further embodiment of an apparatus for mixing a gas main flow sucked in by a radial fan with a gas subflow which is generated completely or partially by a burner.
Figure 4:
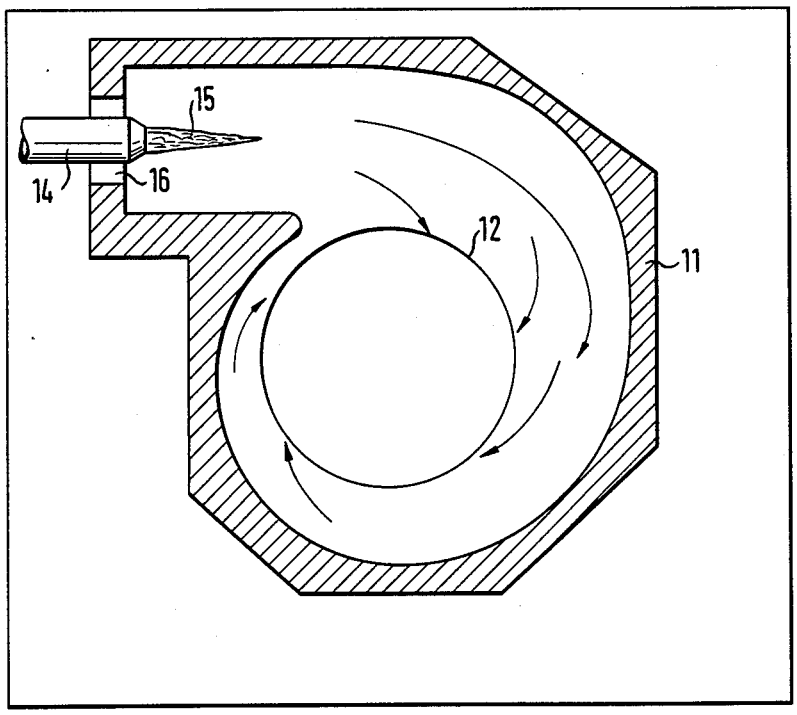
FIG. 4 is a view in the direction B of an apparatus similar to that of FIG. 3 in which the front wall of the apparatus is omitted.

FIGS. 3 and 4 show an embodiment of an apparatus for mixing a gas main flow with a gas subflow which is disposed in the intake region of a radial fan in the roof of a chamber furnace. The hot exhaust gas flow generated by the burner and serving as a gas subflow must be mixed streak-free with the gas main flow sucked in by the radial fan. For this purpose, an annular chamber 11 is provided which surrounds the intake opening 12 of the radial fan 13 in the manner of a spiral housing for a radial fan (see also FIG. 4). By the spiral form of the annular chamber 11, an influx direction of the gas subflow to be admixed is obtained which is the same round the periphery and which without making further provisions itself generates a twist in the subflow. It is then expedient to adapt the form of the influx openings to this twist direction. In this case, it may however also be adequate to provide simple holes as influx openings.

Particularly suitable for this installation situation are high-speed burners in which the injector effect of the burner flow can also be utilized to suck in gas from the surroundings for cooling the region in the vicinity of the flame 15 generated by the burner 14. The gas is sucked through a gap 16 which has been formed between the burner 14 and the associated wall surface of the annular chamber 11. As apparent, in particular, in FIG. 4, this gap 16 thus surrounds the burner tube 14.

For clarity in the view according to FIG. 4, the front wall of the mixing apparatus has been omitted. Thus, a large contact area is obtained which is heated on the one hand from the spiral passage and on the other hand is cooled by the gas main flow sucked in by the radial fan 13. This makes it possible, in spite of the relatively high temperatures in the region of the flame 15, to use materials for constructing the inlet region which, compared with conventional combustion chamber materials, have low temperature resistance, thus reducing costs.

The hot contact area between the gas main flow on the one hand and the burner flow on the other is suitable in directly heated driers also for burning solvent gases which collect in the drying. If such a mixing apparatus is used in a furnace which operates with a small air excess by a chamber disposed in the manner of the chamber 10 in the embodiment according to FIG. 2 behind the burner, the combustion air necessary for the combustion of gaseous constituents can be supplied. A possible field of use for this embodiment is the burning of rolling oil in chamber furnaces for heat treating roll tape coils or the like.

Figure 5:
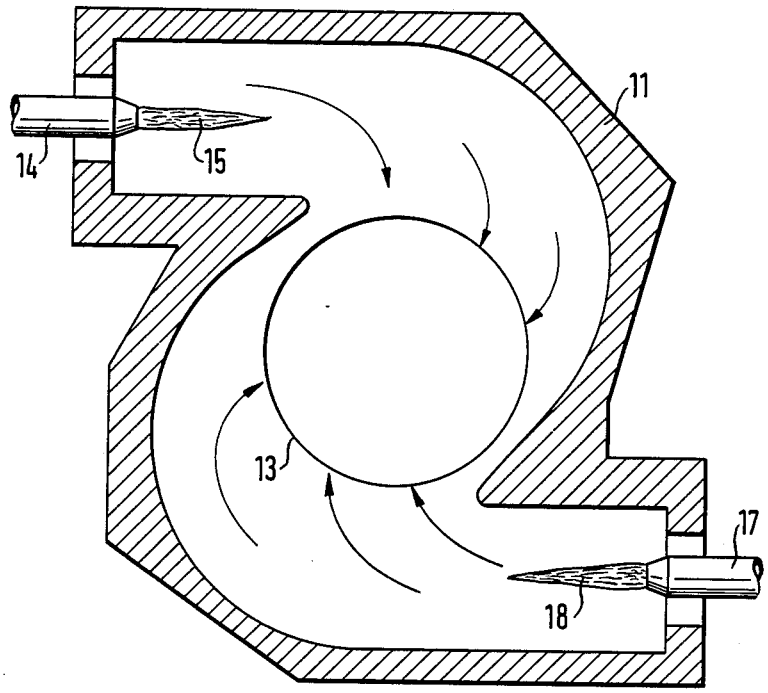
FIG. 5 is a vertical section through another embodiment of an apparatus for mixing a gas main flow with a gas subflow supplied by two burners.

FIG. 5 shows an embodiment in which two burners 14, 17 are arranged offset around the periphery of the influx opening. The flames 15, 18 of the two burners 14, 17 point in the direction of the center line of the spiral housing 11 which surrounds the inlet region of the radial fan 13.

Figure 6:
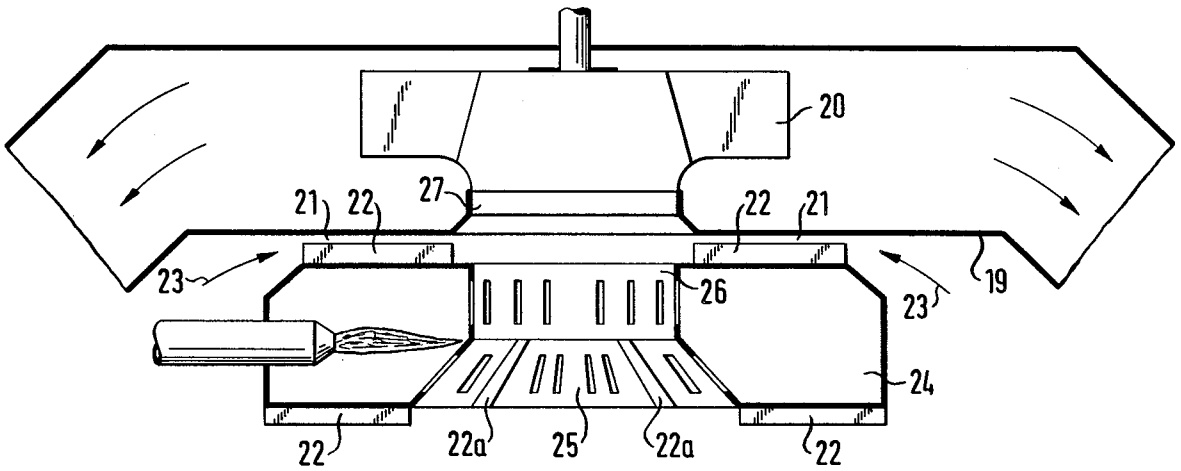
FIG. 6 is an embodiment in which the apparatus is disposed at a certain distance from the front wall of the housing of a radial fan.

FIG. 6 shows an embodiment similar to FIG. 3. However, in this case the apparatus is not directly adjacent the housing 19 of the radial fan 20 but is separated therefrom by a gap 21. On the outer wall faces of the apparatus, ribs 22 are disposed which stiffen the housing, increase the exchange air for the heat transfer and direct the flow. The ribs 22*a*, disposed in the inlet region, are so set that the fraction of the main flow engaged by them is also given a desired direction and thus a twist.

The gap 21 serves for using the fraction of the main flow indicated in FIG. 6 by the flow arrows 23 for cooling the region between the fan housing 19 and apparatus 24. The inlet surrounding the apparatus 24 is divided into a tapering portion 25 and a cylindrical portion 26. The transition between these two portions may however also be gradual. The cylindrical portion 26 is so formed that its diameter differs from the diameter of the inlet ring of the fan 27. By reducing the diameter 26 compared with the diameter 27 the partial vacuum in the inlet region of the apparatus is still further enhanced.

Figure 7:
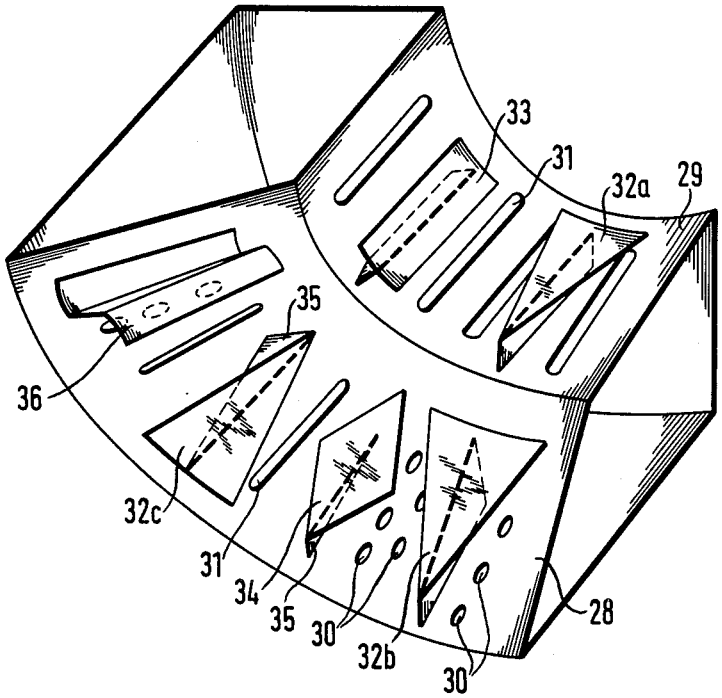
FIG. 7 is a perspective view of a sector of the entry region of an apparatus in which various embodiments of heating means are schematically illustrated.

Finally, in FIG. 7, guide means are illustrated with which the mixing between the main flow and subflow and the resistance time of the fraction of the main flow near the walls at the surfaces of the apparatus with a temperature different from the main flow, can be influenced.

Once again an apparatus is shown with an inlet region which is divided into a tapering portion 28 and an almost cylindrical portion 29. The influx openings 30 are simple holes or slits 31. The guide means are simple sheet elements, for example triangles 32*a*, 32*b* or 32*c*, quadrangles 33 or rhombuses 34. The triangles can point with their apices against the flow direction (32, 32*b*) or in the flow direction 32*c*. The guide means are mounted on supports such as support sheet metal strips 35 which lead to an inclination of the guide means which in the flow direction increases, decreases or remains unchanged. It is also possible to form the guide means as flanged metal sheets 36. Depending on the requirements the influx openings can be arranged completely or partially beneath or adjacent the guide means.

I claim:

1. Apparatus for mixing a gas main flow with at lease one gas subflow, said apparatus comprising:

a round inlet region having the gas main flow entering, said round inlet region tapering in the flow direction, and being an intake opening of a fan;

influx openings having a gas subflow emerge therethrough, said influx openings being distributed at least over a periphery of the inlet region;

at least two chambers arranged in series in the flow direction, at least one of said chambers surrounding said round inlet region, said at least two chambers having said at least one gas subflow flow thereinto, said at least two chambers supplying said gas subflows to said influx openings, said influx opening of said chambers being arranged in series in the flow direction of the main gas flow.

2. Apparatus according to claim 1, in which the gas subflows are supplied perpendicular to the direction of the gas main flow and fed into chambers of said round inlet region with deflection.

3. Apparatus according to claim 1, in which the influx openings for the gas subflows are formed as slit-like nozzle openings which impart to the emerging gas subflow a direction component tangential to the periphery of the inlet region.

4. Apparatus according to claim 3, in which the tangential direction component is the same for all influx openings.

5. Apparatus according to claim 3, in which the tangential direction component for influx openings which are supplied from said two chambers disposed in series is different.

6. Apparatus according to claim 1, in which the influx openings are made gill-like.

7. Apparatus according to claim 1, in which the chamber for supplying the influx openings with the gas subflow is constructed like a spiral housing of a radial fan.

8. Apparatus according to claim 7, in which the gas subflow is generated at least partially by a burner whose flame points in the direction of the center line of the spiral housing.

9. Apparatus according to claim 8, in which at least two burners are arranged offset round the periphery of the inlet region.

10. Apparatus according to claim 1, in which flow guide means are integrated into the influx openings.

11. Apparatus according to claim 1, in which in the region of the influx openings guide means are disposed for guiding the gas main flow entering the inlet region.

12. Apparatus according to claim 1, in which a gap is formed between a rear wall of said round inlet region and a plane end face of an inlet disposed behind said rear wall.

13. Apparatus according to claim 1, in which the cross-section of the inlet first decreases, reaches a minimum and then increases again.

* * * * *